US006827672B2

(12) United States Patent
Miceli

(10) Patent No.: US 6,827,672 B2
(45) Date of Patent: Dec. 7, 2004

(54) APPARATUS FOR ASSISTING AND TRAINING A CHILD TO WALK

(76) Inventor: Joseph Miceli, 81 Beecher St., Southington, CT (US) 06489

( * ) Notice: Subject to any disclaimer, the term of this patent is extended or adjusted under 35 U.S.C. 154(b) by 0 days.

(21) Appl. No.: 10/176,870

(22) Filed: Jun. 21, 2002

(65) Prior Publication Data

US 2003/0236154 A1 Dec. 25, 2003

(51) Int. Cl.[7] ..... A47D 13/04; A63B 1/00
(52) U.S. Cl. ..... 482/69; 482/43
(58) Field of Search ..... 482/43, 69, 48, 482/123–124; 434/250, 255, 247; 280/87.051

(56) References Cited

U.S. PATENT DOCUMENTS

| | | | | | |
|---|---|---|---|---|---|
| 1,193,374 | A | | 8/1916 | Gilliam | |
| 1,816,262 | A | * | 7/1931 | Ritter | 297/484 |
| 2,109,188 | A | * | 2/1938 | Bajanova | 482/69 |
| 2,237,939 | A | | 4/1941 | Klein | 128/126 |
| 2,252,357 | A | * | 8/1941 | Shaw | 297/465 |
| 2,413,395 | A | * | 12/1946 | Ware | 473/576 |
| 2,812,010 | A | * | 11/1957 | Abdallah | 482/69 |
| 2,956,616 | A | * | 10/1960 | Labuskey et al. | 482/69 |
| 3,237,939 | A | * | 3/1966 | Olivet et al. | 482/69 |
| 4,164,350 | A | * | 8/1979 | Zeijdel et al. | 482/69 |
| 4,907,972 | A | | 3/1990 | Marolda | 434/255 |
| 5,120,287 | A | | 6/1992 | Brown | 482/69 |
| 5,325,550 | A | | 7/1994 | Dearstyne | 5/89.1 |
| 5,356,355 | A | * | 10/1994 | Campbell | 482/43 |
| 5,476,070 | A | | 12/1995 | Gwon | 119/770 |
| 5,498,219 | A | | 3/1996 | Soufi | 482/69 |
| 5,540,188 | A | | 7/1996 | Heinrichs | 119/770 |
| 5,766,114 | A | | 6/1998 | Campbell | 482/55 |
| 6,125,792 | A | | 10/2000 | Gee | 119/770 |
| 6,196,949 | B1 | * | 3/2001 | Rodarte | 482/69 |
| 6,325,023 | B1 | | 12/2001 | Elnatan | 119/770 |
| 6,338,699 | B1 | | 1/2002 | Veitch | 482/69 |
| 6,361,478 | B1 | | 3/2002 | Giancaspro | 482/69 |

* cited by examiner

*Primary Examiner*—Nicholas D. Lucchesi
*Assistant Examiner*—Fenn C. Mathew
(74) *Attorney, Agent, or Firm*—McCormick, Paulding & Huber LLP

(57) ABSTRACT

An apparatus for assisting a child to walk comprises a handlebar including a first handle having a grip portion. A pair of second handles each have a grip portion substantially coplanar with one another. The second handles are connected to and extend laterally outwardly from the first handle. The first handle and the second handles together define a space disposed laterally inwardly of the second handles sized to accommodate a child's head. A harness includes a loop for surrounding the torso of a child, and a connector for coupling the loop to the handle.

19 Claims, 4 Drawing Sheets

APPARATUS FOR ASSISTING AND TRAINING A CHILD TO WALK

FIELD OF THE INVENTION

This invention relates generally to an apparatus for supporting children, and more particularly relates to an apparatus for assisting and training a child to walk.

BACKGROUND OF THE INVENTION

When children begin to walk they typically grab onto an adult's fingers lifting up themselves while holding tightly to the adult's fingers because they feel secure by holding onto something or someone. Unfortunately, an adult typically must bend over while helping a child stand and walk which can result in tiring, straining or otherwise injuring the adult's back. Moreover, it is often awkward for the adult to walk while being bent over, and difficult to avoid tripping on the child's feet. Moreover, should a child trip, release his or her grip or otherwise begin to fall, it is difficult for the adult to act quickly enough to prevent the child from falling. Devices have been developed to help a child walk and prevent the child from falling. However, such prior art devices typically comprise complex structures and do not make adequate provision for permitting the child to both hold onto and balance himself or herself.

In response to the foregoing, it is an object of the present invention to overcome the drawbacks and disadvantages of prior art devices for assisting a child to walk.

SUMMARY OF THE INVENTION

In a first aspect of the present invention, an apparatus for assisting a child to walk comprises a handlebar including a first handle having a grip portion. A pair of second handles each have a grip portion substantially coplanar with one another. The second handles are connected to and extend laterally outwardly from the first handle, and the first handle and the second handles together define a space disposed laterally inwardly of the second handles sized to accommodate a child's head. A harness includes a loop for surrounding the torso of a child, and means for coupling the loop to the handle.

In a second aspect of the present invention, an apparatus for assisting a child to walk comprises a generally rigid handlebar including a first handle having a grip portion. A pair of second handles each have a grip portion substantially coplanar with one another. The second handles are connected to and extend laterally outwardly from the first handle. The first handle and the second handles together define a space disposed laterally inwardly of the second handles sized to accommodate a child's head. A harness includes a loop including a strap for surrounding the torso of a child, and a pair of back straps coupling the loop to the handle. The pair of back straps generally form a crisscross pattern.

DETAILED DESCRIPTION OF THE PREFERRED EMBODIMENTS

Figure 2:
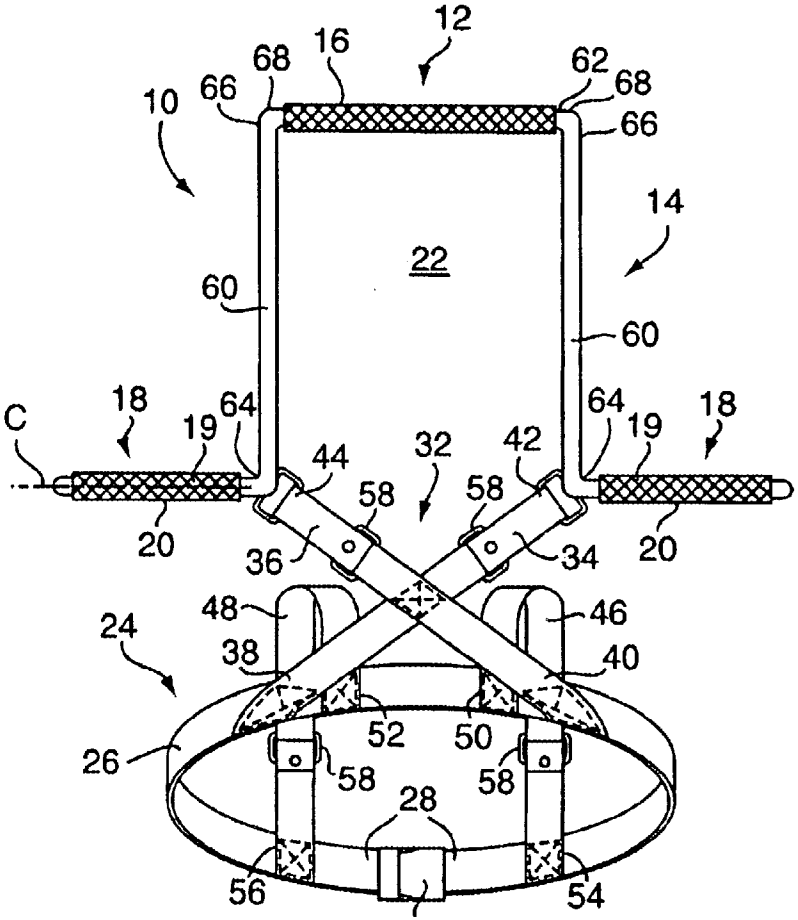
FIG. 2 is a back perspective view of the apparatus of FIG. 1.

With reference to FIGS. 1–4, an apparatus for assisting and training a child to walk is in accordance with a first embodiment is indicated generally by the reference number 10. The apparatus 10 includes a generally rigid handlebar 12 including a first handle 14 having a grip portion 16 to be grasped by an adult. A pair of second handles 18, 18, for being grasped by a child, each has a grip portion 20 preferably substantially coplanar with the other grip portion of the other second handle. Preferably the grip portion 16 of the first handle 14 and the grip portions 20, 20 of the second handles 18, 18 each have means for enhancing a grip thereon or non-slippery surface 19 such as, for example, a plurality of grooves defined by the grip portions or a sleeve including a non-slippery surface such as rubber placed over the grip portions. The second handles 18, 18 are connected to and extend laterally outwardly from the first handle 14. The first handle 14 and the second handles 18, 18 together define a space 22 to accommodate a child's head. Preferably the first handle 14 is coplanar with the second handles 18, 18 so that the handlebar 12 is generally flat and can be stored or transported in a narrow space.

Figure 1:
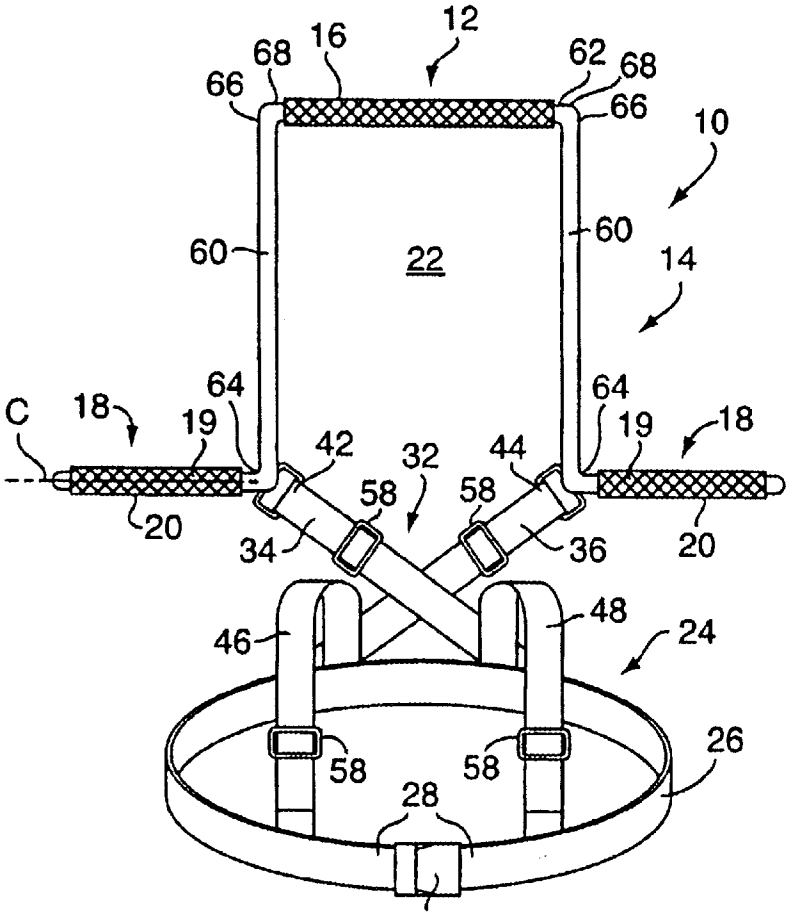
FIG. 1 is a front perspective view of an apparatus for assisting and training a child to walk in accordance with the present invention.
Figure 3:
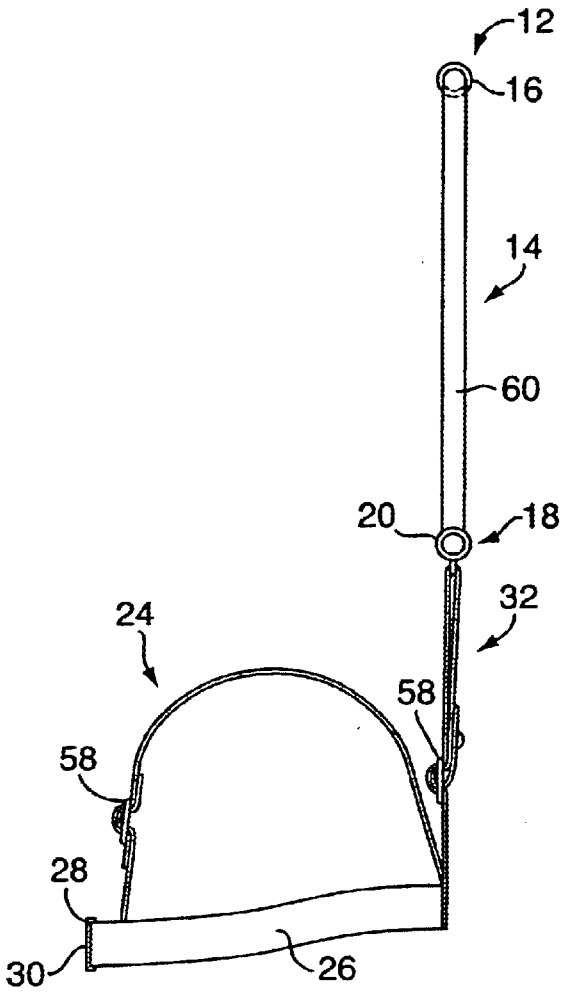
FIG. 3 is a side elevation view of the apparatus of FIG. 1.

A harness indicated generally by the reference number 24 includes a flexible loop 26 including a strap for surrounding the torso of a child such as the waist, or more preferably the chest. The loop 26 has ends 28, 28 which may be tied together in a temporary knot. Preferably the ends 28, 28 of the loop 26 include means for attaching the ends of the loop together. As best shown in FIGS. 1 and 2, for example, the ends 28, 28 of the loop 26 include a releasable snap-fit connector 30 for connecting the ends and adjusting the effective length of the loop, but may include other releasable connectors such as hook and loop fasteners without departing from the scope of the present invention. Means for coupling the loop 26 to the handlebar 12 comprises, for example, a flexible elongated connector 32 including at least one strap.

As shown in FIGS. 1 and 2, the flexible elongated connector 32 includes first and second back straps 34 and 36 coupled at respective first ends 38 and 40 generally to opposite rearward sides of the loop 26 relative to each other, and coupled at respective second ends 42 and 44 generally to opposite sides of the handlebar 12 relative to each other such that the back straps are crisscrossed. First and second shoulder straps 46 and 48 for supporting the loop 26 around a child's chest have respective first ends 50 and 52 coupled generally to opposite rearward sides of the loop 26 relative to each other, and have respective second ends 54 and 56 coupled generally to opposite frontward sides of the loop relative to each other. Preferably, the straps include means for adjusting the effective length of the straps, such as adjustment slide fasteners 58, 58. As best shown in FIGS. 1 and 2, for example, the first and second back straps 34, 36 and the first and second shoulder straps 46, 48 each include an adjustment slide fastener 58. Although the harness 24 is illustrated in the form of straps, it should be understood by those skilled in the pertinent art that the harness may take other forms such as ropes without departing from the scope of the present invention.

The first handle 14 preferably has a pair of first elongated members 60, 60 and a second elongated member 62 including the grip portion 16 for grasping by an adult. The first members 60, 60 are spaced in generally parallel relation with one another and have first ends 64, 64 coupled to a respective second handle 18. Further, the first members 60, 60 have second ends 66, 66 coupled to adjacent associated ends 68, 68 of the second member 62. Preferably the first handle 14 and the second handles 18, 18 of the handlebar 12 are of unitary construction with one another, but may be separate members that are connected together without departing from the scope of the present invention.

Preferably, the second handles 18, 18 extend outwardly generally along a common axis C that is horizontal when the apparatus 10 is operationally attached to a child. The horizontally oriented second handles 18, 18 permit a child to easily grasp the grip portions 20, 20 positioned above and slightly laterally outwardly from the child's shoulders as an aid in steadying and balancing the child.

In operation, the harness 24 is secured to a child by placing the loop 26 around the child's chest and under the arms, and the shoulder straps 46, 48 are placed over the child's shoulders. The ends 28, 28 of the loop are fastened together by engaging the releasable snap-fit connector 30. One end 28 of the loop 26 is pulled to adjust the effective length of the loop 26 to conform to the size of the child's chest. The harness 24 is also fitted to the child by adjusting the adjustment slide fasteners 58 on the first and second back straps 34, 36 and the first and second shoulder straps 46, 48.

Figure 4:
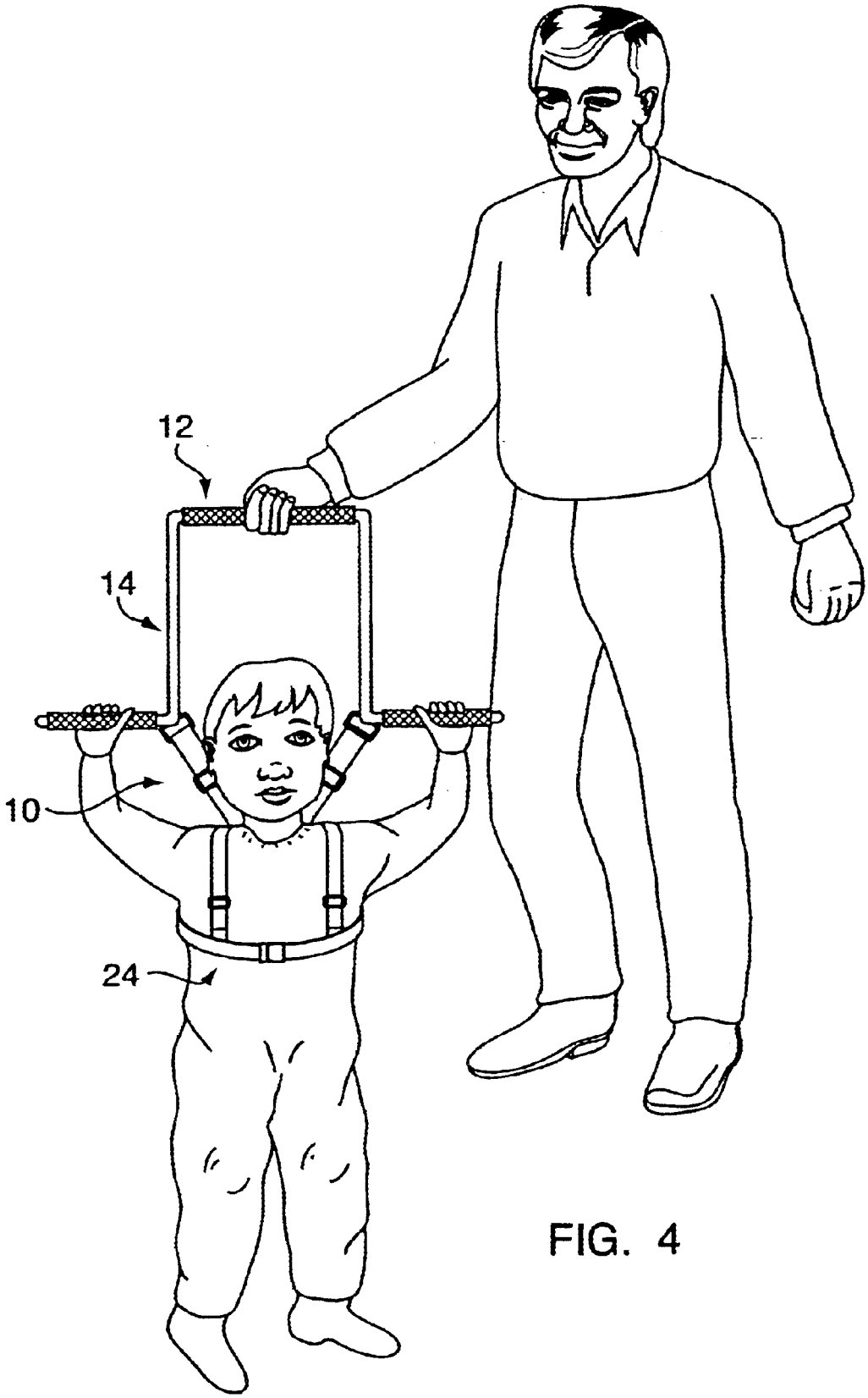
FIG. 4 is a front view of the apparatus attached to a child.
Figure 5:
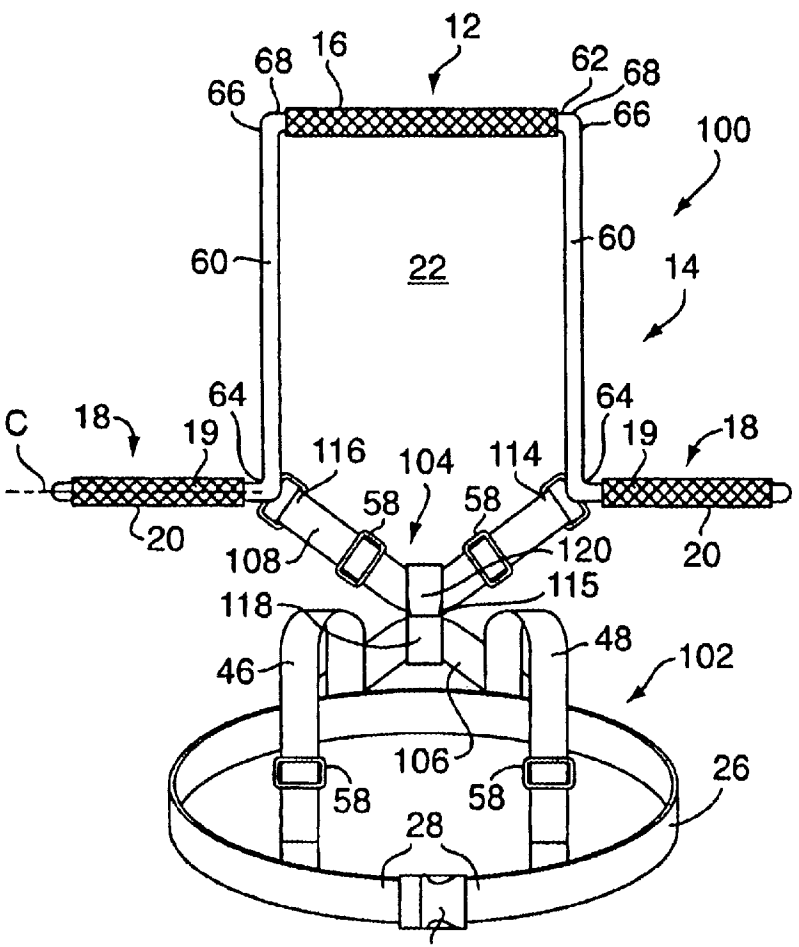
FIG. 5 is a front perspective view of an apparatus for assisting and training a child to walk in accordance with a second embodiment of the present invention.

An adult grasps the first handle 14 by the grip portion 16 and lifts the handlebar 12 so that the harness 24 is generally taut and supports the child in an upright position, and so that the second handles 18, 18 are located laterally of the child's shoulders. The first handle 14 is positioned above the child's head to permit the adult to grasp the grip portion 16 without bending over, thereby significantly reducing the chance of the adult tiring, straining or otherwise injuring his or her back. As shown in FIGS. 4 and 5, preferably the first and second back straps 34, 36 are sized so that the second handles 18, 18 are located slightly above the child's shoulders such as about midway between the top of the child's head and chin. The child grabs the second handles 18, 18 by the grip portions 20, 20 giving himself or herself a feeling of security, and thereafter may begin to walk with the aid of the apparatus 10. The back straps 34, 36 are crisscrossed relative to each other to permit the child to twist and turn his or her head and shoulders without being restricted, as opposed to back straps which vertically extend down the child's back. The adult can help the child walk by moving the first handle 14 forwardly which transmits the forward movement to the child via the first and second back straps 34, 36. The adult can also steer the direction of the child's movement by turning the direction of the first handle 14 which in turn twists the back straps 34, 36 to orient the child in the direction the adult wants the child to move.

The position of the second handles 18, 18 laterally of the child's shoulders permits the child to extend the arms laterally outwardly of his or her center of gravity to better steady the child and to prevent the child from losing his or her balance. If the child should trip, release the second handles 18, 18 or begin to fall, the adult provides an upward force on the first handle 14 so that the loop 26 and the back straps 34, 36 of the harness 24 coupled to the first handle counter the child's weight and prevent the child from falling. Moreover, as the child begins to fall, the downward force exerted by the child on the loop 26 causes the first ends 38, 40 of respective crisscrossed back straps 34, 36 to come together so as to further tighten the loop 26 and thereby prevent the child from slipping through the loop.

Figure 7:
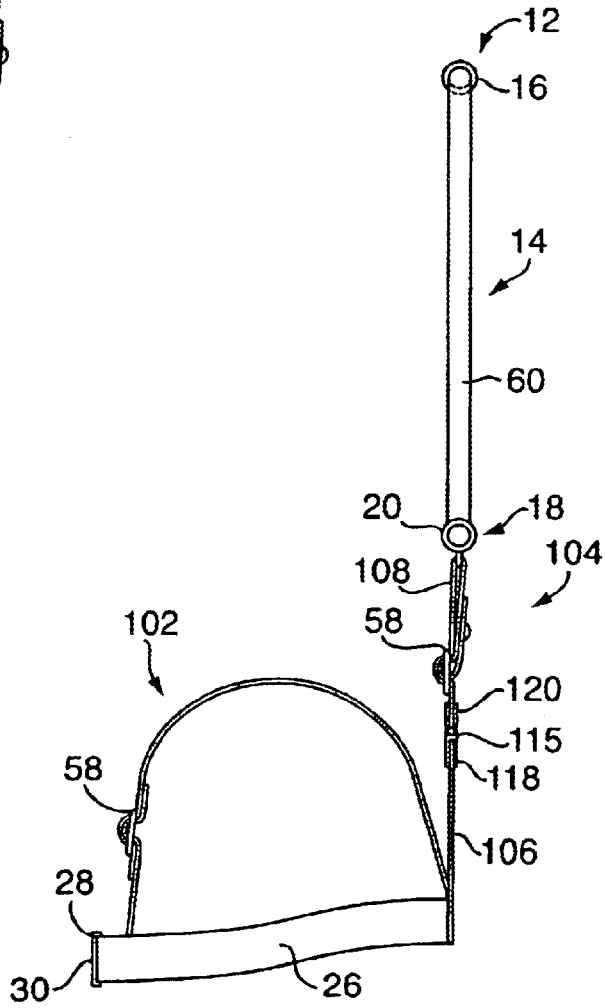
FIG. 7 is a side elevation view of the apparatus of FIG. 5.
Figure 6:
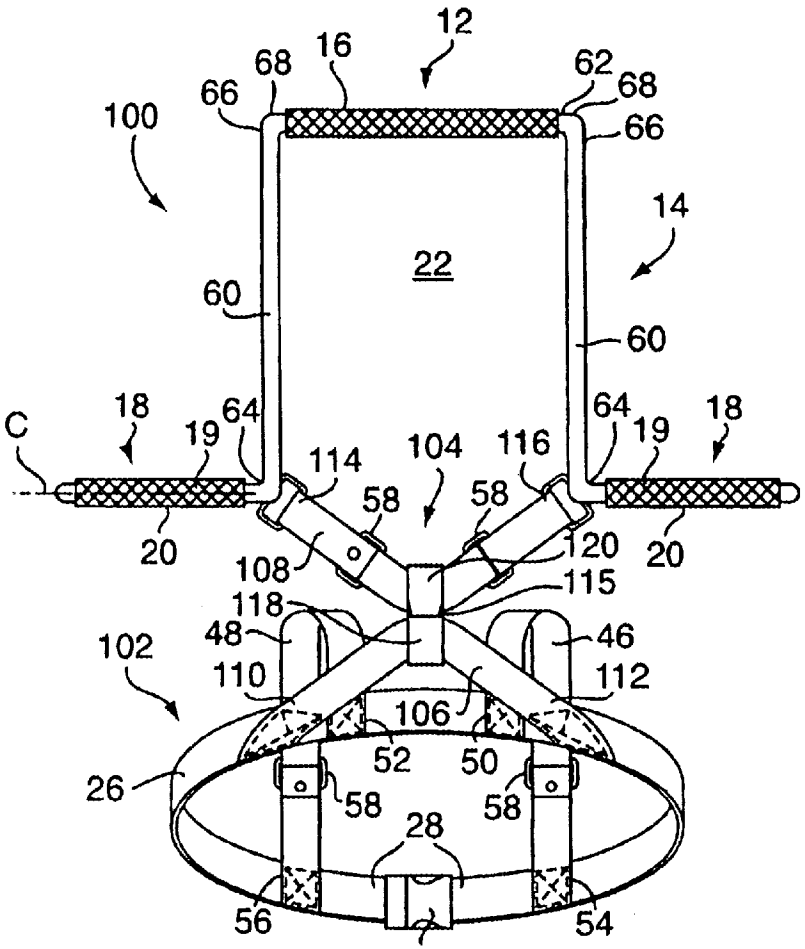
FIG. 6 is a back perspective view of the apparatus of FIG. 5.

FIGS. 5–7 illustrate an apparatus 100 for assisting and training a child to walk in accordance with a second embodiment of the present invention. Like elements with those shown in the embodiment of FIGS. 1–4 are indicated by like reference numbers. The apparatus 100 is generally the same as the apparatus 10 shown and described with reference to FIGS. 1–4 except for the harness.

As shown in FIGS. 5–7, a harness indicated generally by the reference number 102 includes a flexible loop 26 including a strap for surrounding the torso of a child such as the waist, or more preferably the chest. The loop 26 has ends 28, 28 which may be tied together in a temporary knot. Preferably the ends 28, 28 of the loop 26 include means for attaching the ends of the loop together. As best shown in FIGS. 5 and 6, for example, the ends 28, 28 of the loop 26 include a releasable snap-fit connector 30 for connecting the ends and adjusting the effective length of the loop, but may include other releasable connectors such as hook and loop fasteners without departing from the scope of the present invention. Means for coupling the loop 26 to the handlebar 12 comprises, for example, a flexible elongated connector 104 including at least one strap.

As shown in FIGS. 5 and 6, the flexible elongated connector 104 includes first and second back straps 106 and 108. The first back strap 106 is coupled at a first end 110 to a rearward side of the loop 26, and coupled at a second end 112 generally to an opposite rearward side of the loop relative to the first end 110. The second back strap 108 is coupled at a first end 114 to one side of the handlebar 12, and coupled at a second end 116 generally to an opposite side of the handlebar 12 relative to the first end 114. A second connector 115, preferably a releasable snap-fit connector, has a first member 118 coupled to the first back strap 106 at a location generally midway between the first end 110 and the second end 112 of the first back strap 106. Similarly, the second connector 116 has a second member 120 coupled to the second back strap 108 at a location generally midway between the first end 114 and the second end 115 of the second back strap 108. The first and second members 118, 120 of the second connector 116 releasably engage one another to, in turn, releasably couple the loop 26 to the handlebar 12. As shown in FIGS. 5 and 6, the first and second back straps 106, 108 together generally form a crisscross pattern when the second connector 116 is engaged.

Preferably, one or more of the first and second back straps 106, 108 include means for adjusting the effective length of the straps, such as adjustment slide fasteners 58, 58. Preferably, the second back strap 108 includes a first adjustment slide fastener located adjacent to the first end 114, and a second adjustment slide fastener located adjacent to the second end 116. The harness 102 operates generally similarly to the harness 24 of FIGS. 1–4 except that the harness 102 provides for a simple and quick way to connect the handlebar 12 to the loop 26, and to disconnect the handlebar from the loop. For example, the harness 102 is secured to a child by placing the loop 26 around the child's chest and under the arms, and the shoulder straps 46, 48 are placed over the child's shoulders. The ends 28, 28 of the loop are fastened together by engaging the releasable snap-fit connector 30. One end 28 of the loop 26 is pulled to adjust the effective length of the loop 26 to conform to the size of the child's chest. The handlebar 12 is then coupled to the loop 26 by engaging the first and second members 118, 120 of the second connector 115.

Should the adult wish to divide the training into several sessions, at the end of a session the adult need only disengage the first and second members 118, 120 of the second connector 116 to separate the handlebar 12 from the loop 26 around the child's chest. The child can then be free to crawl about with the loop 26 about its chest without being encumbered by the handlebar 12 which would otherwise trail behind the child. When the adult wishes to begin a new training session, the adult need only engage the first and second members 118, 120 of the second connector 116 to reattach the handlebar 12 to the loop 26 about the child's chest.

As will be recognized by those of ordinary skill in the pertinent art, numerous modifications and substitutions may be made to the above-described embodiment of the present invention without departing from the scope of the invention as set forth in the appended claims. Accordingly, the preceding portion of this specification is to be taken in an illustrative, as opposed to a limiting sense.

What is claimed is:

1. An apparatus for assisting a child to walk, comprising:

a handlebar including:

a first handle having a grip portion;

a pair of second handles each having a grip portion substantially coplanar with one another, the second handles being connected to and having ends extending laterally outwardly from the first handle in opposite directions relative to each other, and the first handle and the second handles together defining a space disposed laterally inwardly of the second handles sized to accommodate a child's head; and a harness including:

a loop for surrounding the torso of a child; and means for coupling the loop to the handle bar.

2. An apparatus as defined in claim 1, wherein the harness includes straps.

3. An apparatus as defined in claim 2, wherein the coupling means of the harness includes first and second back straps each coupled at a first end to the loop, and each coupled at a second end to the handlebar.

4. An apparatus as defined in claim 3, wherein the first and second back straps are coupled at the first ends generally to opposite rearward sides of the loop relative to each other, and coupled at the second ends to a different one of the second handles with respect to each other such that the first and second back straps are crisscrossed.

5. An apparatus as defined in claim 4, wherein the harness further includes first and second shoulder straps having first ends coupled generally to opposite rearward sides of the loop relative to each other, and having second ends coupled generally to opposite frontward sides of the loop relative to each other.

6. An apparatus as defined in claim 2, further including means for adjusting the length of the straps.

7. An apparatus as defined in claim 1, wherein the first handle and the second handles are substantially coplanar with one another.

8. An apparatus as defined in claim 1, wherein a length of the second handles extend along a common axis.

9. An apparatus as defined in claim 8, wherein the first handle includes a pair of first elongated members and a second elongated member including the grip portion, the first members being spaced in generally parallel relation with one another and having first ends coupled to a respective second handle, and having second ends coupled to respective ends of the second elongated member.

10. An apparatus as defined in claim 1, wherein the loop has ends including hook and loop fasteners for connecting the ends together.

11. An apparatus as defined in claim 1, wherein the loop has ends including a releasable snap-fit connector.

12. An apparatus as defined in claim 1, wherein the handle includes means for enhancing a grip thereon.

13. An apparatus as defined in claim 12, wherein the means for enhancing a grip thereon includes a plurality of grooves defined by the grip portions of the first and second handles.

14. An apparatus as defined in claim 12, wherein the means for enhancing a grip thereon includes a sleeve having a generally non-slippery surface.

15. An apparatus as defined in claim 14, wherein the non-slippery surface is selected from the group including rubber and plastic.

16. An apparatus as defined in claim 1, wherein the handlebar is generally rigid.

17. An apparatus as defined in claim 2, wherein the coupling means of the harness includes first and second back straps, the first back strap having first and second ends coupled to opposite rearward sides of the loop relative to each other, the second back strap having first and second ends coupled to opposite sides of the handlebar relative to each other, and further including a connector for releasably connecting the first and second back straps to each other.

18. An apparatus as defined in claim 17, wherein the connector is a releasable snap-fit connector.

19. An apparatus for assisting a child to walk, comprising:

a generally rigid handlebar including:

a first handle having a grip portion;

a pair of second handles each having a grip portion substantially coplanar with one another, the second handles being connected to and having ends extending laterally outwardly from the first handle in opposite directions relative to each other, and the first handle and the second handles together defining a space disposed laterally inwardly of the second handles sized to accommodate a child's head; and a harness including:

a loop including a strap for surrounding the torso of a child; and a pair of back straps coupling the loop to the handle, the pair of back straps generally forming a crisscross pattern.

* * * * *

UNITED STATES PATENT AND TRADEMARK OFFICE

CERTIFICATE OF CORRECTION

PATENT NO. : 6,827,672 B2
DATED : December 7, 2004
INVENTOR(S) : Joseph Miceli

It is certified that error appears in the above-identified patent and that said Letters Patent is hereby corrected as shown below:

Column 6,
Line 53, "handle" should read as -- handlebar --.

Signed and Sealed this

Fifth Day of April, 2005

JON W. DUDAS
*Director of the United States Patent and Trademark Office*